US010808431B2

(12) United States Patent
Su

(10) Patent No.: US 10,808,431 B2
(45) Date of Patent: Oct. 20, 2020

(54) LOCK FOR ELECTRONIC DEVICES

(71) Applicant: Jason Su, Changhua (TW)

(72) Inventor: Jason Su, Changhua (TW)

( * ) Notice: Subject to any disclaimer, the term of this patent is extended or adjusted under 35 U.S.C. 154(b) by 157 days.

(21) Appl. No.: 16/214,687

(22) Filed: Dec. 10, 2018

(65) Prior Publication Data

US 2020/0181951 A1 Jun. 11, 2020

(51) Int. Cl.
*E05B 73/00* (2006.01)

(52) U.S. Cl.
CPC ..... *E05B 73/0082* (2013.01); *E05B 73/0005* (2013.01); *E05Y 2900/606* (2013.01)

(58) Field of Classification Search
CPC .. E05B 73/00; E05B 73/0005; E05B 73/0082; E05Y 2900/606
USPC ..... 70/14, 57, 58
See application file for complete search history.

(56) References Cited

U.S. PATENT DOCUMENTS 6,058,744 A * 5/2000 Ling ..... E05B 37/025 70/28
10,400,482 B2 * 9/2019 Kao ..... E05B 73/0082
2003/0200775 A1 * 10/2003 Yu ..... E05B 37/025 70/58
2007/0169523 A1 * 7/2007 Lu ..... E05B 73/0082 70/58
2008/0034816 A1 * 2/2008 Lu ..... E05B 73/0082 70/58
2008/0053168 A1 * 3/2008 Lu ..... E05B 73/0005 70/58
2010/0300158 A1 * 12/2010 Andres ..... G06F 1/16 70/58
2014/0069153 A1 * 3/2014 Wu ..... E05B 73/0082 70/58
2015/0059422 A1 * 3/2015 Kao ..... E05B 73/00 70/58
2017/0247916 A1 * 8/2017 Kao ..... E05B 73/0082
2018/0209179 A1 * 7/2018 Lin ..... E05B 73/0082
2018/0363334 A1 * 12/2018 Wu ..... E05B 73/0082
2019/0112840 A1 * 4/2019 Wu ..... E05B 73/0082
2020/0080346 A1 * 3/2020 Wu ..... E05B 73/0082
2020/0181950 A1 * 6/2020 Su ..... E05B 37/02

* cited by examiner

*Primary Examiner* — Lloyd A Gall
(74) *Attorney, Agent, or Firm* — Che-Yang Chen; Law Office of Michael Chen

(57) ABSTRACT

A lock for electronic devices may include a main body, a lock barrel, a pushing member, and two engaging pieces. The main body has a cover and a cylinder which are connected together at a front portion and a rear portion of the main body. The cover comprises a through hole at a central portion thereof, and two pivot bases are respectively formed at two lateral sides of the through hole in the cover. The lock barrel comprising a lock pin is installed in the cylinder of the main body, and the lock pin is configured to protrude from a rear end of the cylinder when the lock of present invention is at an unlocked position. The pushing member is installed in a front portion of the cylinder, and a rear end of the pushing member is coupled with the lock pin so as to have synchronous movement.

7 Claims, 7 Drawing Sheets

LOCK FOR ELECTRONIC DEVICES

FIELD OF THE INVENTION

The present invention relates to a lock, and more particularly to a lock for electronic devices such as notebook, laptop and tablet.

BACKGROUND OF THE INVENTION

Nowadays, the electronic product such as notebook, laptop and tablet becomes lighter, thinner and smaller, and because of easily carried place to place, they are becoming desirable targets for thieves. Therefore, there remains a need for a new and improved design for a lock for electronic product to overcome the problems presented above.

SUMMARY OF THE INVENTION

The present invention provides a lock for electronic devices which comprises a main body, a lock barrel, a pushing member, and two engaging pieces. The main body has a cover and a cylinder which are connected together at a front portion and a rear portion of the main body. Also, the cover comprises a through hole at a central portion thereof, and two pivot bases are respectively formed at two lateral sides of the through hole in the cover. The lock barrel comprising a lock pin is installed in the cylinder of the main body, and the lock pin is configured to protrude from a rear end of the cylinder when the lock of present invention is at an unlocked position. The pushing member is installed in a front portion of the cylinder, and a rear end of the pushing member is coupled with the lock pin so as to have synchronous movement. When the lock is unlocked, the lock pin of the lock barrel is configured to drive the pushing member to completely move into the main body. On the other hand, when the lock is locked, the lock pin of the lock barrel is adapted to push the pushing member forwardly, and a front end of the pushing member is configured to protrude out from the through hole of the cover. A rotating ring disposed on the main body is connected to a cable. The pushing member comprises a connecting section and a cone-shaped portion respectively formed at a rear portion and a front portion thereof, and the connecting section is adapted to connect to the lock pin. Each of the engaging pieces has a first portion and a second portion connected together with a designed bending angle. Moreover, each of engaging blocks formed at a front end of the first portion comprises an outer surface, and each of connecting portions is formed at a rear end of the second portion of the engaging piece. The two connecting portions of the two engaging pieces are respectively and pivotally connected to the two pivot bases of the cover so as to enable the two engaging pieces to be installed in the cover of the main body, and an end of each of the engaging pieces which has the engaging block is configured to penetrate through the through hole of the cover. Furthermore, the cone-shaped portion of the pushing member is adapted to couple between the two second portions of the engaging pieces. An elastic ring is disposed on the two engaging pieces, and through elastic force, the elastic ring is configured to pull back and keep the two engaging pieces to couple together at the two first portions thereof when the lock of the present invention is from a locked position back to the unlocked position.

Comparing with conventional 3C product lock, the present invention is advantageous because: (i) the lock of the present invention can be used for the electronic product having the rectangle lock hole or the fishtail lock hole; and (ii) the lock will not affect the use of electronic product, and it is easy for a user to operate between the locked and unlocked positions.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
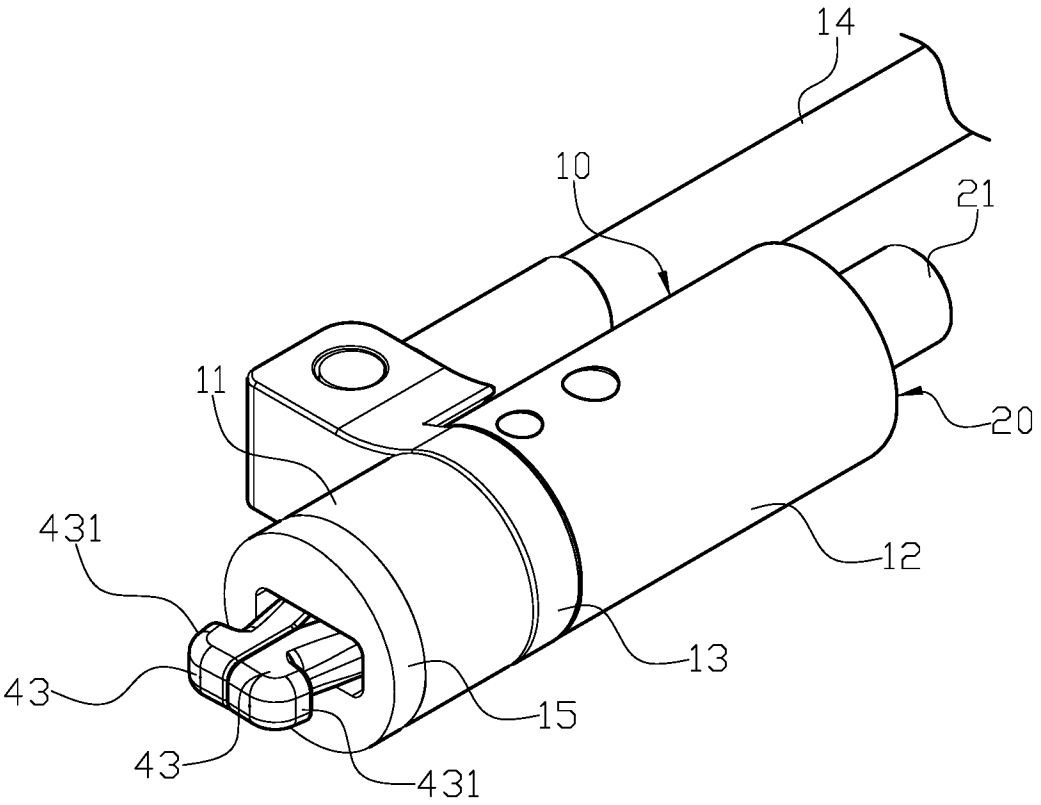
FIG. 1 is a three-dimensional assembly view of a lock for electronic devices in the present invention.
Figure 2:
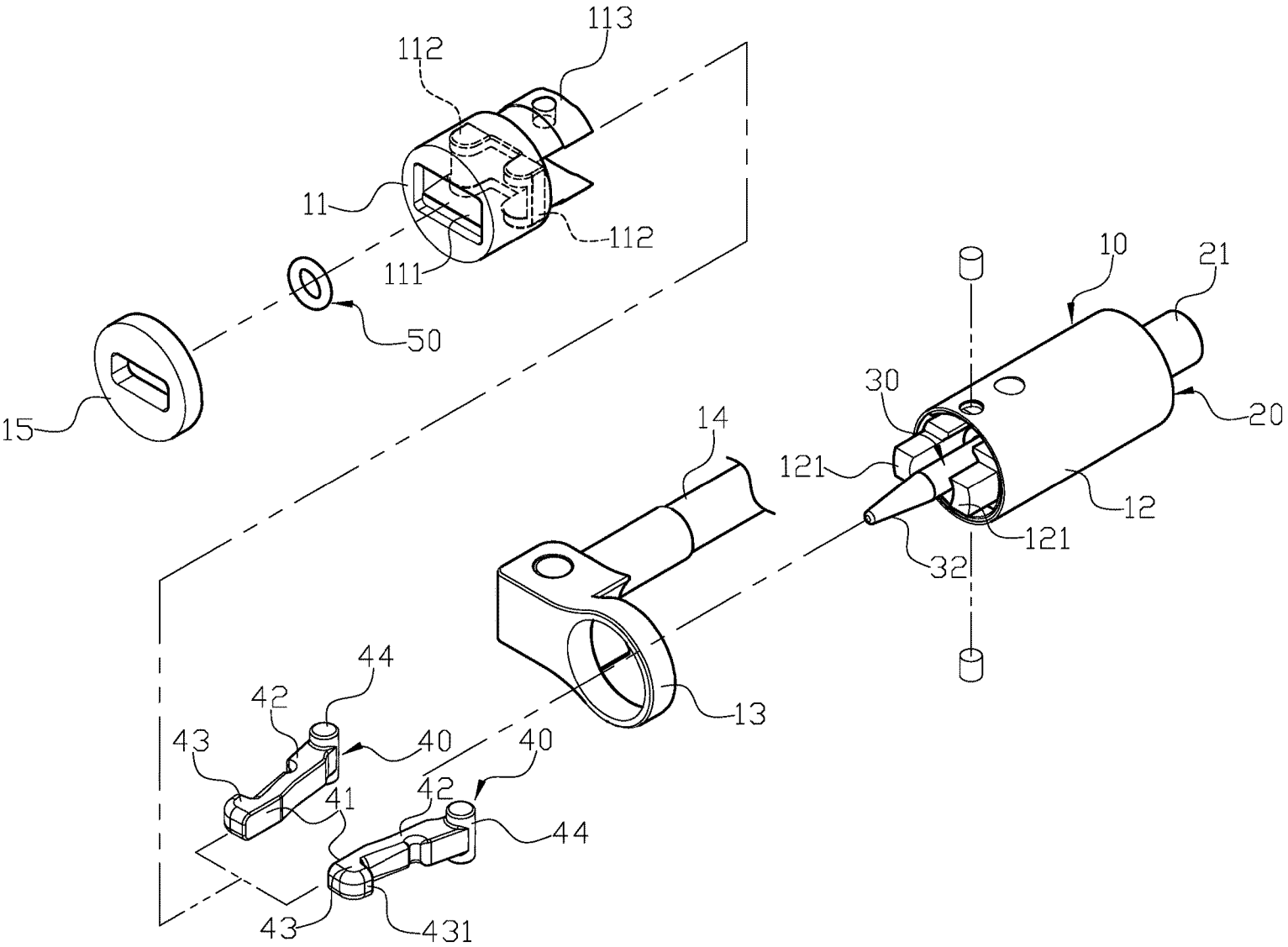
FIG. 2 is a three-dimensional exploded view of the lock for electronic devices in the present invention.
Figure 3:
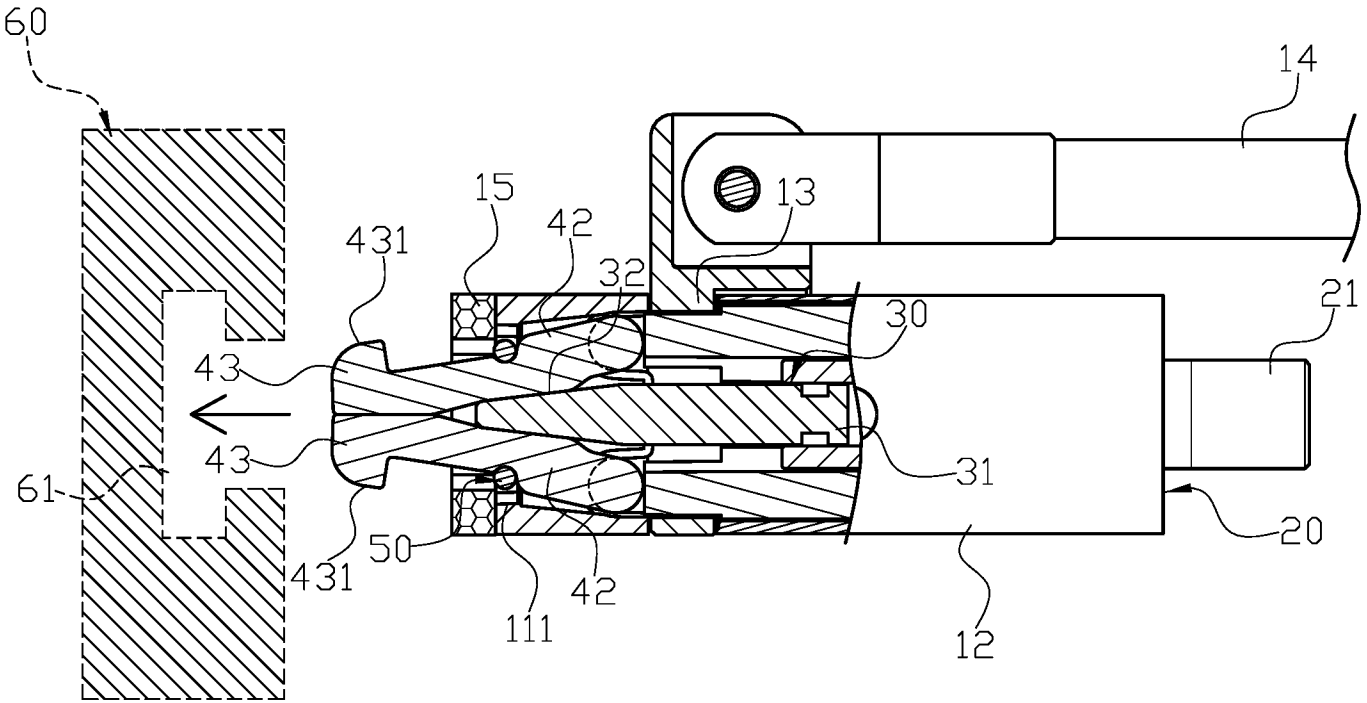
FIG. 3 is a schematic view illustrating the lock of the present invention is inserted into a rectangle lock hole of an electronic device.

In order to further understand the goal, characteristics and effect of the present invention, a number of embodiments along with the drawings are illustrated as following:

Referring to FIGS. 1 to 3, the present invention provides a lock for electronic devices which comprises a main body (10), a lock barrel (20), a pushing member (30), and two engaging pieces (40). The main body (10) has a cover (11) and a cylinder (12) which are connected together at a front portion and a rear portion of the main body (10). Also, the cover (11) comprises a through hole (111) at a central portion thereof, and two pivot bases (112) are respectively formed at two lateral sides of the through hole (111) in the cover (11).

The lock barrel (20) comprising a lock pin (21) is installed in the cylinder (12) of the main body (10), and the lock pin (21) is configured to protrude from a rear end of the cylinder (12) when the lock of present invention is at an unlocked position. The pushing member (30) is installed in a front portion of the cylinder (12), and a rear end of the pushing member (30) is coupled with the lock pin (21) so as to have synchronous movement. When the lock is unlocked, the lock pin (21) of the lock barrel (20) is configured to drive the pushing member (30) to completely move into the main body (10). On the other hand, when the lock is locked, the lock pin (21) of the lock barrel (20) is adapted to push the pushing member (30) forwardly, and a front end of the pushing member (30) is configured to protrude out from the through hole (111) of the cover (11). A rotating ring (13) disposed on the main body (10) is connected to a cable (14). The pushing member (30) comprises a connecting section (31) and a cone-shaped portion (32) respectively formed at a rear portion and a front portion thereof, and the connecting section (31) is adapted to connect to the lock pin (21). Each of the engaging pieces (40) has a first portion (41) and a second portion (42) connected together with a designed bending angle. Moreover, each of engaging blocks (43) formed at a front end of the first portion (41) comprises an outer surface (431), and each of connecting portions (44) is formed at a rear end of the second portion (42) of the engaging piece (40). The two connecting portions (44) of the engaging pieces (40) are respectively and pivotally connected to the two pivot bases (112) of the cover (11) so as to enable the two engaging pieces (40) to be installed in the cover (11) of the main body (10), and an end of each of the engaging pieces (40) having the engaging block (43) is configured to penetrate through the through hole (111) of the cover (11). Furthermore, the cone-shaped portion (32) of the pushing member (30) is adapted to couple between the two second portions (42) of the engaging pieces (40). An elastic ring (50) is disposed on the two engaging pieces (40), and through elastic force, the elastic ring (50) is configured to pull back and keep the two engaging pieces (40) to couple together at the two first portions (41) thereof when the lock of the present invention is from a locked position back to the unlocked position.

In one embodiment, a neck portion (113) protruding from a rear end of the cover (11) has an outer diameter smaller than the cover (11), and the neck portion (113) is configured to insert into the cylinder (12), and the neck portion (113) of the cover (11) and the cylinder (12) are secured together through bolts.

In another embodiment, an impact protection ring (15) is connected at a front end of the cover (11).

In still another embodiment, two guiding blocks (121) respectively formed at two lateral sides of the lock pin (21) in the cylinder (12) are configured to guide and limit the lock pin (21) to move in horizontal direction.

In a further embodiment, the lock barrel (20) is a key lock barrel.

In still a further embodiment, each of the outer surfaces (431) is a cutting edge which provides a space to enable the lock of the present invention to be used for a rectangle lock hole (61) and a fishtail lock hole (62).

In a particular embodiment, the elastic ring (50) is an O-shaped rubber ring.

Figure 4:
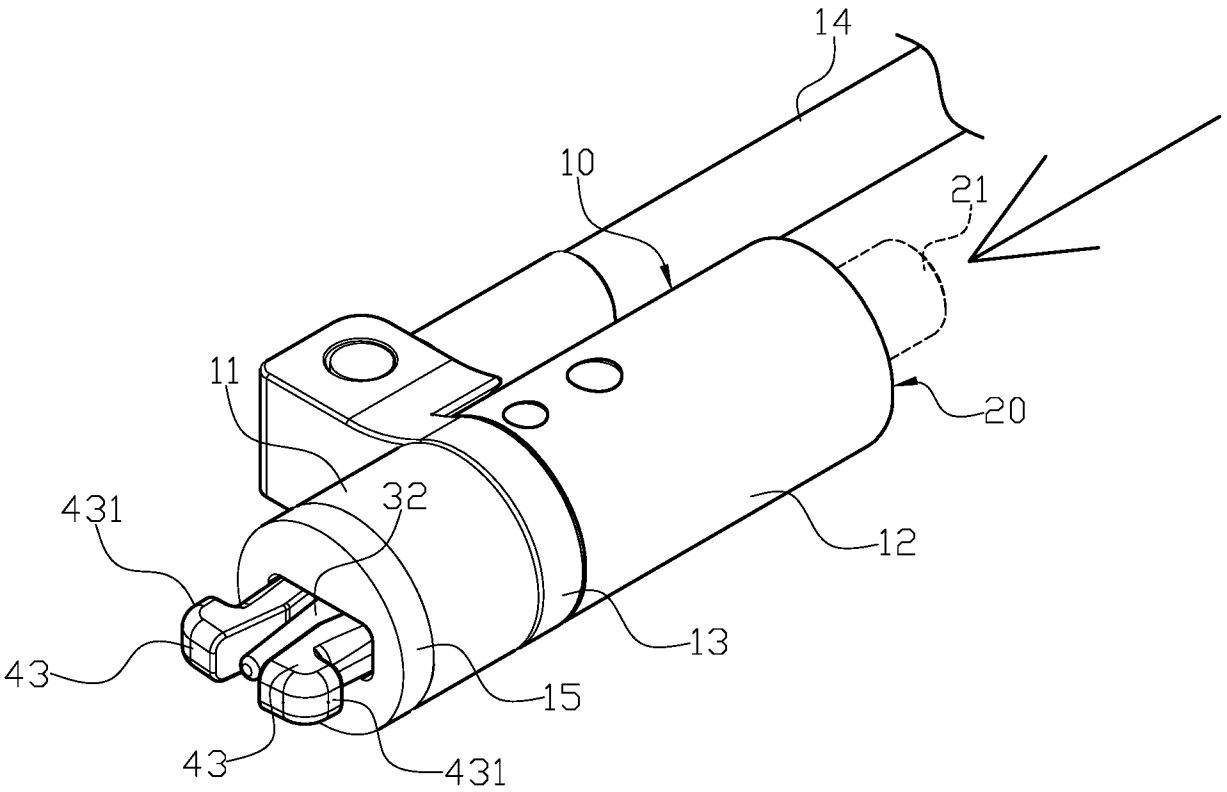
FIG. 4 is a three-dimensional view illustrating the lock for electronic devices is at a locked position.
Figure 5:
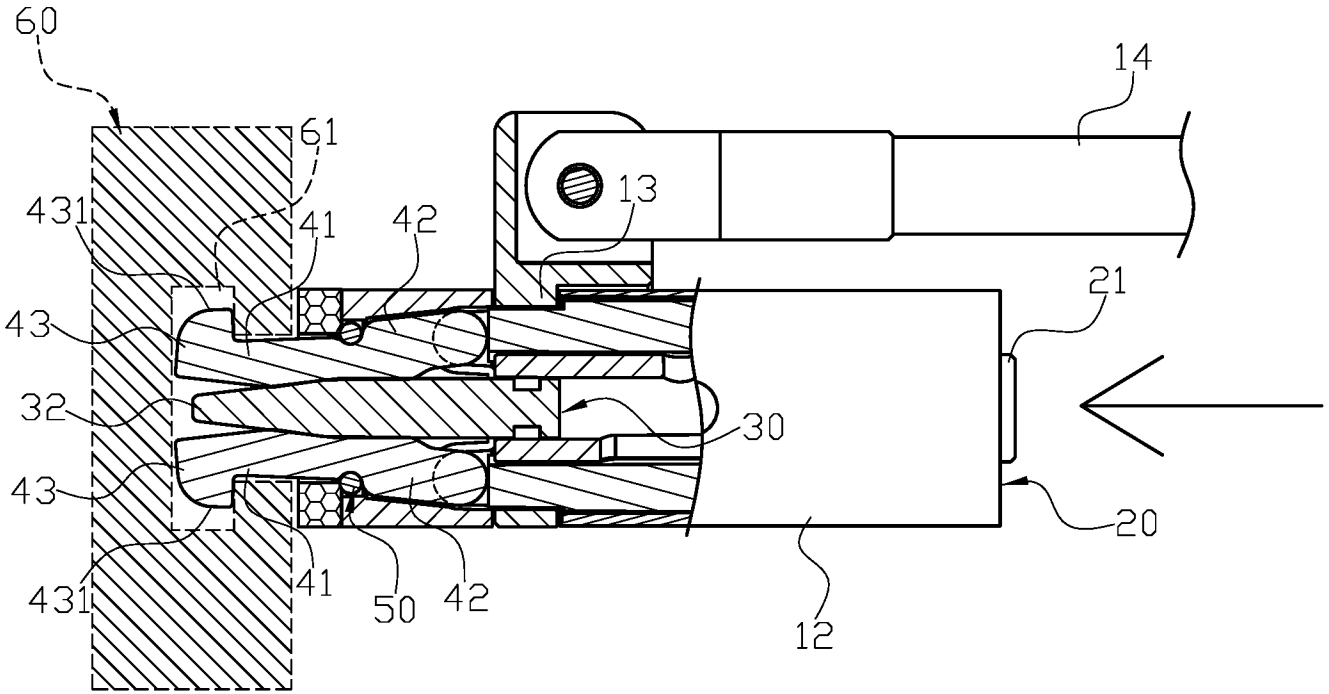
FIG. 5 is a schematic view illustrating the lock of the present invention is used for the electronic device having the rectangle lock hole.
Figure 6:
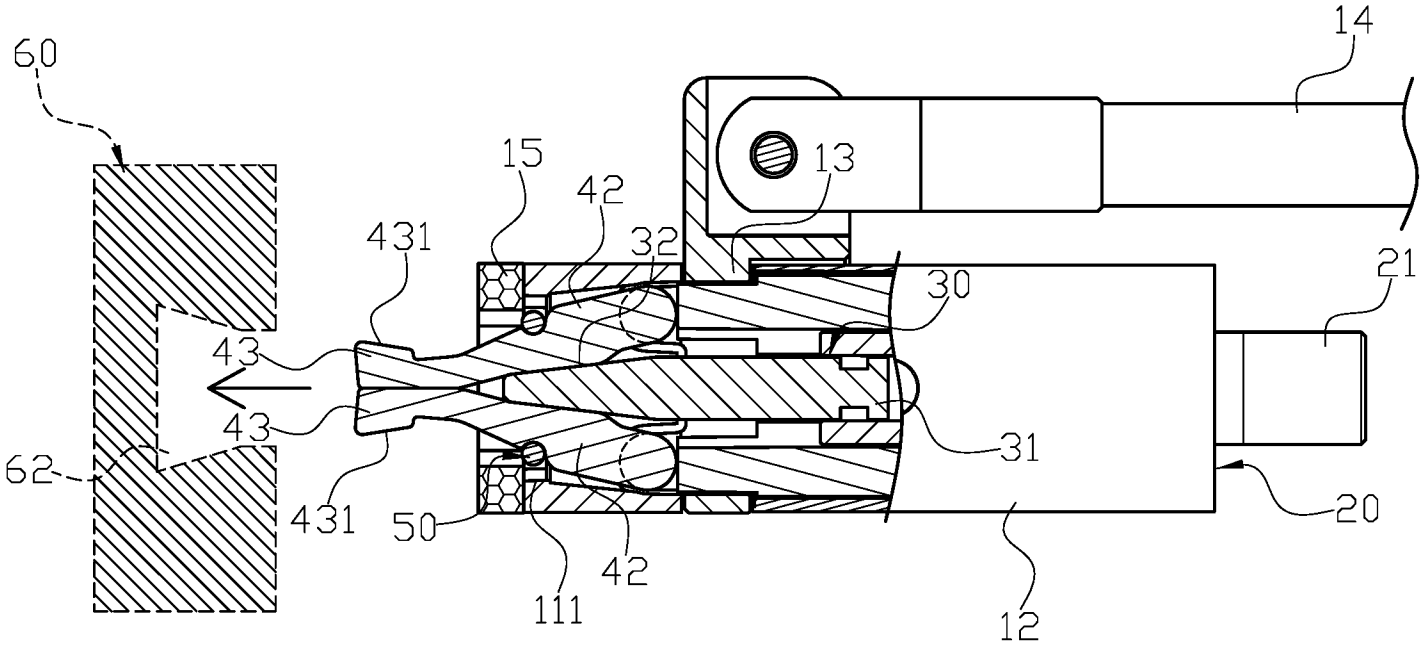
FIG. 6 is a schematic view illustrating the lock of the present invention is inserted into a fishtail lock hole of an electronic device.
Figure 7:
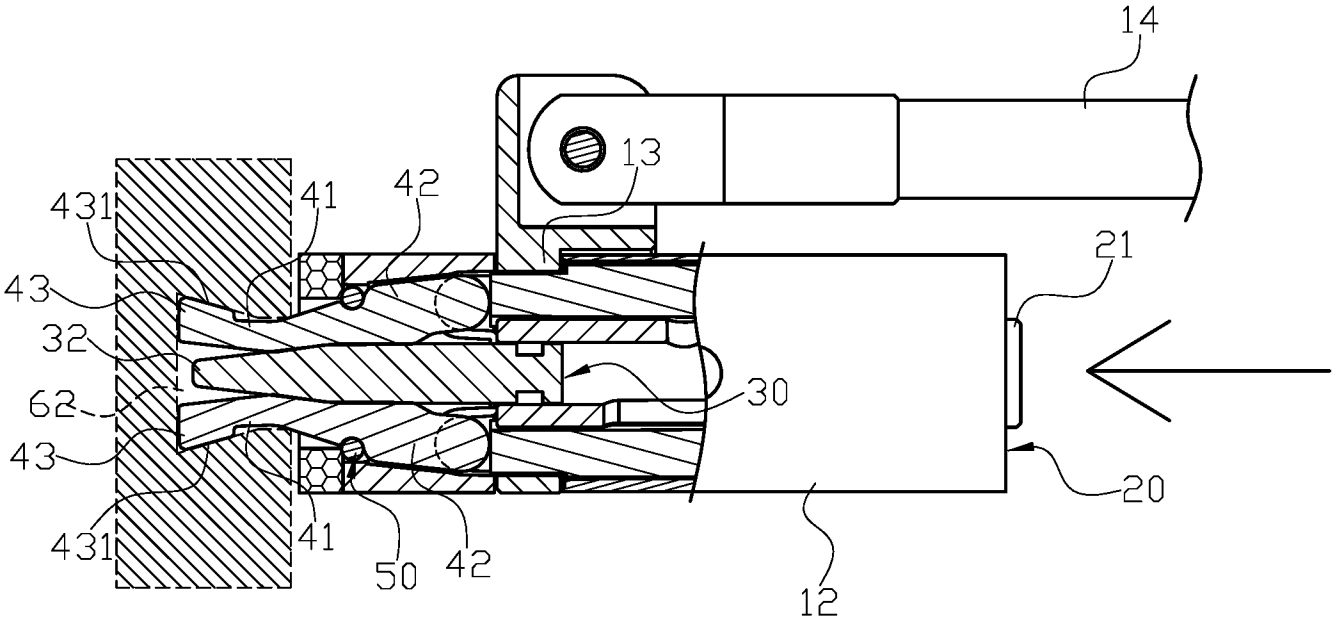
FIG. 7 is a schematic view illustrating the lock of the present invention is used for the electronic device having the fishtail lock hole.

In actual application, referring to FIG. 3, the engaging pieces (40) are configured to insert into the rectangle lock hole (61) of an electronic device (60) through the engaging blocks (43), and a user can press the lock pin (21) to push the pushing member (30), and the front portion of the pushing member (30) is adapted to pass through the through hole (111) of the cover (11), and the cone-shaped portion (32) of the pushing member (30) is moved forward to separate the two first portions (41) of the engaging pieces (40) (as shown in FIG. 4) so as to enable the engage pieces (40) to engage with the rectangle lock hole (61) (as shown in FIG. 5), thereby locking the electronic device (60). Also, with the collaboration between the lock pin (21), the pushing member (30), the cone-shaped portion (32), and the engaging pieces (40), the lock of the present invention can also apply to the electronic device (60) having the fishtail lock hole (62) (as shown in FIGS. 6 and 7). When the lock is unlocked, the lock pin (21) is configured to move back at its initial position located behind the main body (10) and also pull the pushing member (30) backwardly. Furthermore, the engaging pieces (40) are adapted to be pulled back to the initial positions by the elastic ring (50), and the two first portions (41) of the engaging pieces (40) are configured to be re-coupled together while the pushing member (30) is adapted to be moved back to the initial position between the two second portions (42) of the engaging pieces (40). Through the contact between the cone-shaped portion (32) and the two second portions (42) of the engaging pieces (40), the cone-shaped portion (32) can smoothly move forwardly and separate the first portions (41) apart when the lock of the present invention is at a locked position next time.

Comparing with conventional 3C product lock, the present invention is advantageous because: (i) the lock of the present invention can be used for the electronic device (60) having the rectangle lock hole (61) or the fishtail lock hole (62); and (ii) the lock will not affect the use of the electronic device (60), and it is easy for a user to operate between the locked and unlocked positions.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A lock for electronic devices comprising a main body, a lock barrel, a pushing member, and two engaging pieces;

wherein the main body has a cover and a cylinder which are connected together at a front portion and a rear portion of the main body; the cover comprises a through hole at a central portion thereof, and two pivot bases are respectively formed at two lateral sides of the through hole in the cover; the lock barrel comprising a lock pin is installed in the cylinder of the main body, and the lock pin is configured to protrude from a rear end of the cylinder when the lock is at an unlocked position; the pushing member is installed in a front portion of the cylinder, and a rear end of the pushing member is coupled with the lock pin so as to have synchronous movement; when the lock is unlocked, the lock pin of the lock barrel is configured to drive the pushing member to completely move into the main body; when the lock is locked, the lock pin of the lock barrel is adapted to push the pushing member forwardly, and a front end of the pushing member is configured to protrude out from the through hole of the cover; the main body is connected to a cable through a rotating ring disposed on an outer periphery of the main body;

wherein the pushing member comprises a connecting section and a cone-shaped portion respectively formed at a rear portion and a front portion thereof, and the connecting section is adapted to connect to the lock pin; and wherein each of the engaging pieces has a first portion and a second portion connected together with a designed bending angle; each of engaging blocks formed at a front end of the first portion comprises an outer surface, and each of connecting portions is formed at a rear end of the second portion of the engaging piece; the two connecting portions of the two engaging pieces are respectively and pivotally connected to the two pivot bases of the cover so as to enable the two engaging pieces to be installed in the cover of the main body, and an end of each of the engaging pieces which has the engaging block is configured to forwardly penetrate through the through hole of the cover; the cone-shaped portion of the pushing member is adapted to couple between the two second portions of the engaging pieces; an elastic ring is disposed on the two engaging pieces, and through elastic force, the elastic ring is configured to pull back and keep the two engaging pieces to couple together at the two first portions thereof when the lock is from a locked position back to the unlocked position.

2. The lock for electronic devices of claim 1, wherein a neck portion protruding from a rear end of the cover has an outer diameter smaller than the cover, and the neck portion is configured to insert into the cylinder, and the neck portion of the cover and the cylinder are secured together through bolts.

3. The lock for electronic devices of claim 1, wherein an impact protection ring is connected at a front end of the cover.

4. The lock for electronic devices of claim 1, wherein two guiding blocks respectively formed at two lateral sides of the lock pin in the cylinder are configured to guide and limit the lock pin to move in horizontal direction.

5. The lock for electronic devices of claim 1, wherein the lock barrel is a key lock barrel.

6. The lock for electronic devices of claim 1, wherein each of the outer surfaces is a cutting edge which provides a space to enable the lock to be used for a rectangle lock hole and a fishtail lock hole of an electronic device.

7. The lock for electronic devices of claim 1, wherein the elastic ring is an O-shaped rubber ring.

* * * * *